US006131992A

United States Patent [19]

Chang

[11] Patent Number: 6,131,992

[45] Date of Patent: Oct. 17, 2000

[54] FOLDABLE CHAIR SUPPORTED BY REAR SUPPORTING LEGS

[76] Inventor: Mei-Fang Chang, 4F, No. 10, Alley 78, Lane 182, Rd. Research Institute, Taipei, Taiwan

[21] Appl. No.: 09/322,921

[22] Filed: Jun. 1, 1999

[51] Int. Cl.[7] ..... A47C 4/00

[52] U.S. Cl. ..... 297/58; 297/55

[58] Field of Search ..... 297/58, 55, 50, 297/48

[56] References Cited

U.S. PATENT DOCUMENTS

| | | | |
|---|---|---|---|
| 1,633,721 | 6/1927 | Young | 297/58 |
| 1,724,055 | 8/1929 | Wagner | 297/58 |
| 2,729,275 | 1/1956 | Morgan et al. | 297/58 |
| 4,123,101 | 10/1978 | Minsker | 297/58 |

FOREIGN PATENT DOCUMENTS

| | | | |
|---|---|---|---|
| 1415805 | 9/1964 | France | 297/55 |
| 147202 | 3/1981 | Germany | 297/58 |

*Primary Examiner*—Laurie K. Cranmer
*Attorney, Agent, or Firm*—Dougherty & Troxell

[57] ABSTRACT

A foldable chair supported by rear supporting legs is disclosed. The rear supporting legs are directly connected to a seat. A positioning structure for resisting against the seat is installed at the fulcrum of the front supporting leg. When the seat is expanded, the fulcrum of each supporting leg practically suffers force from the seat, thus the force is distributed uniformly to the four legs. In using, even the user leans against the chair back, the chair may be still steady. The chair back has a cambered surface. After being folding, the volume occupied does not increase. Therefore, the packaging material will be saved.

3 Claims, 8 Drawing Sheets

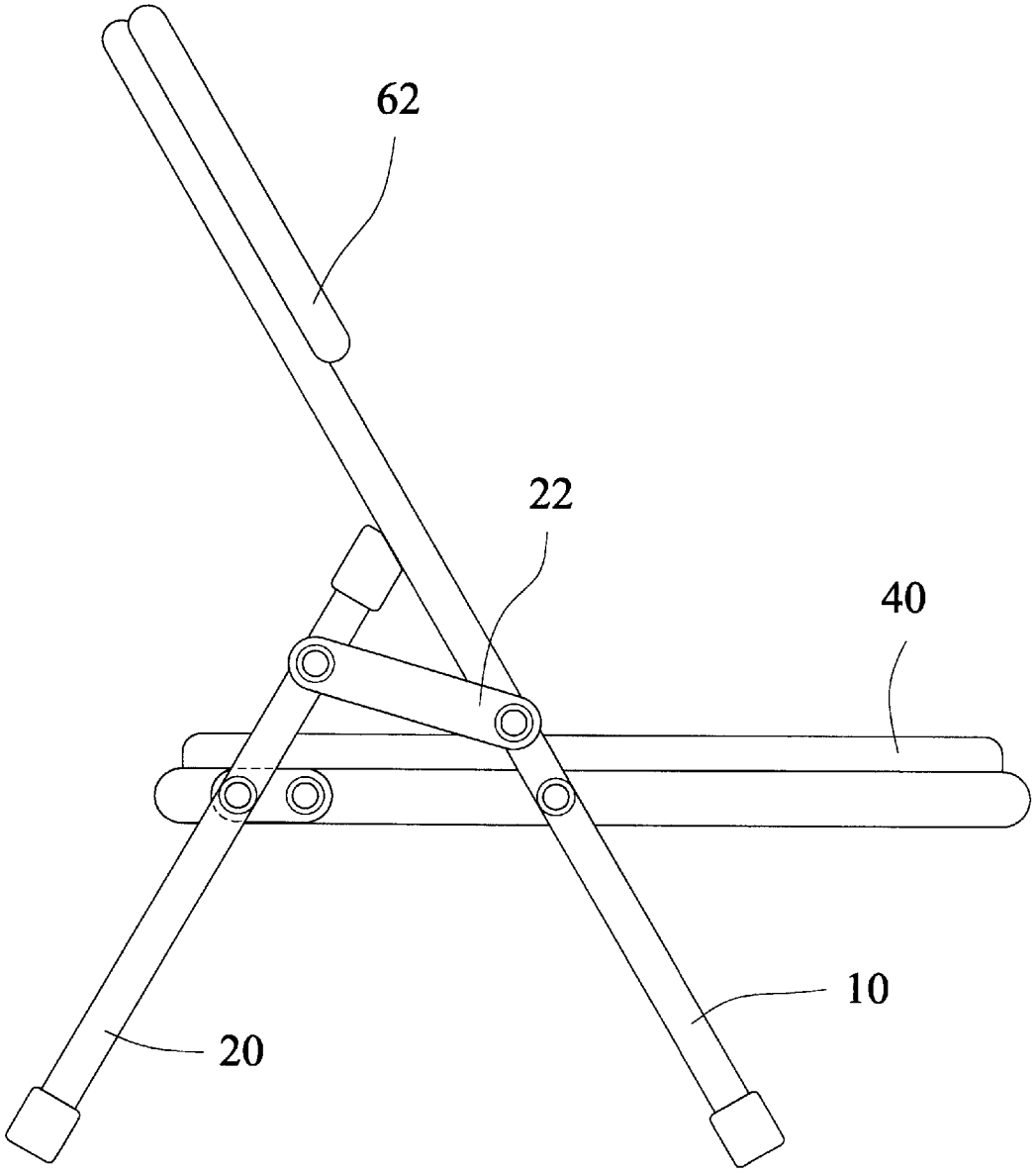
FIG. 5-A

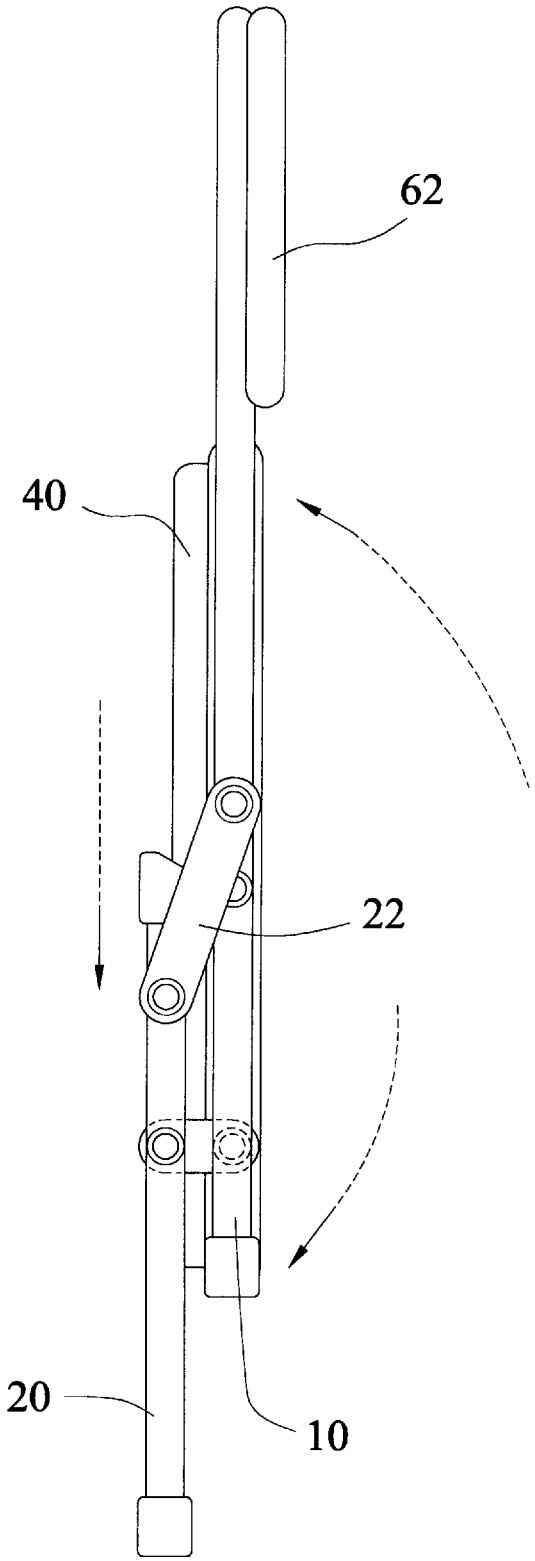
FIG. 5-B

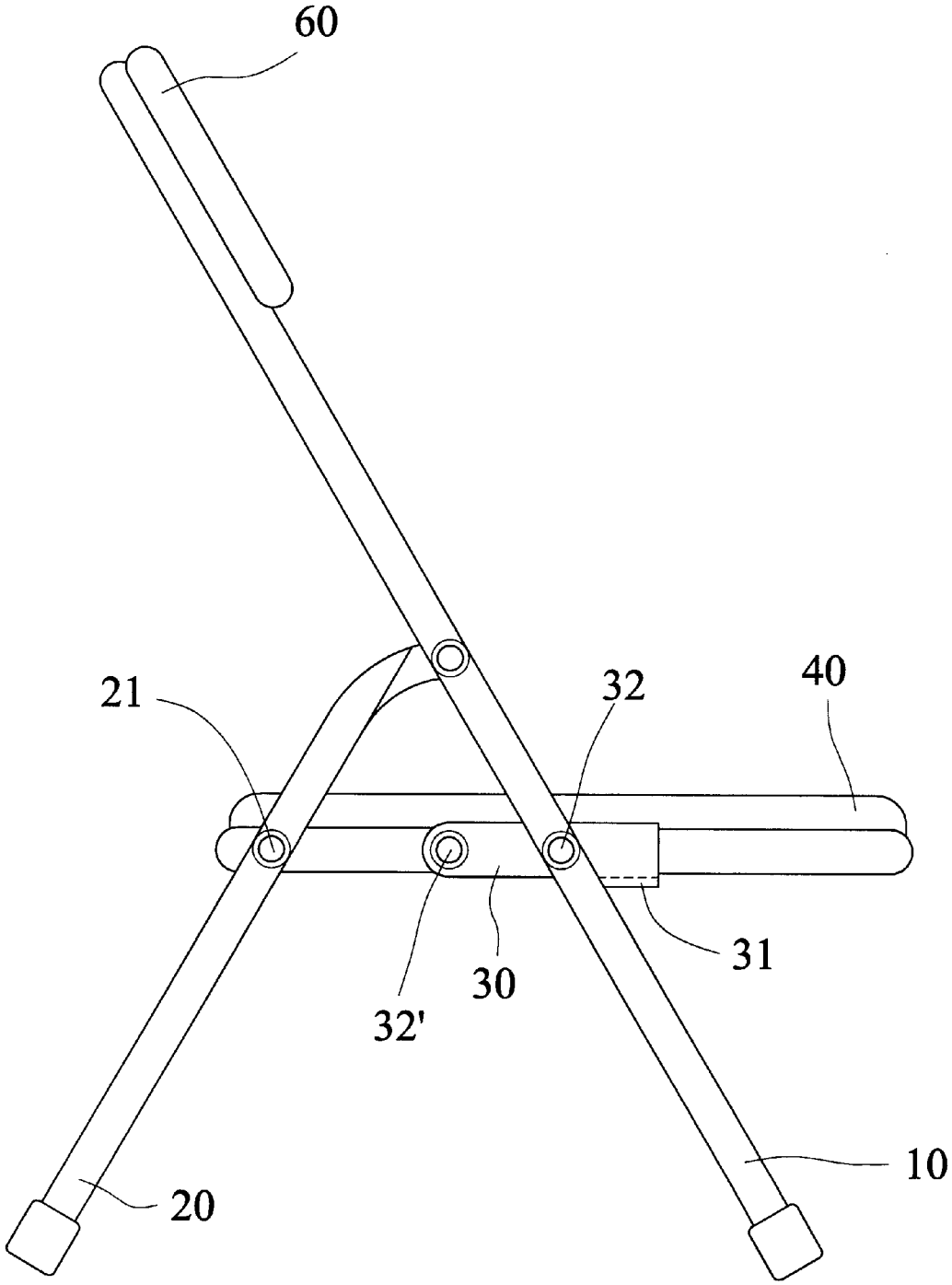
FIG. 6-A

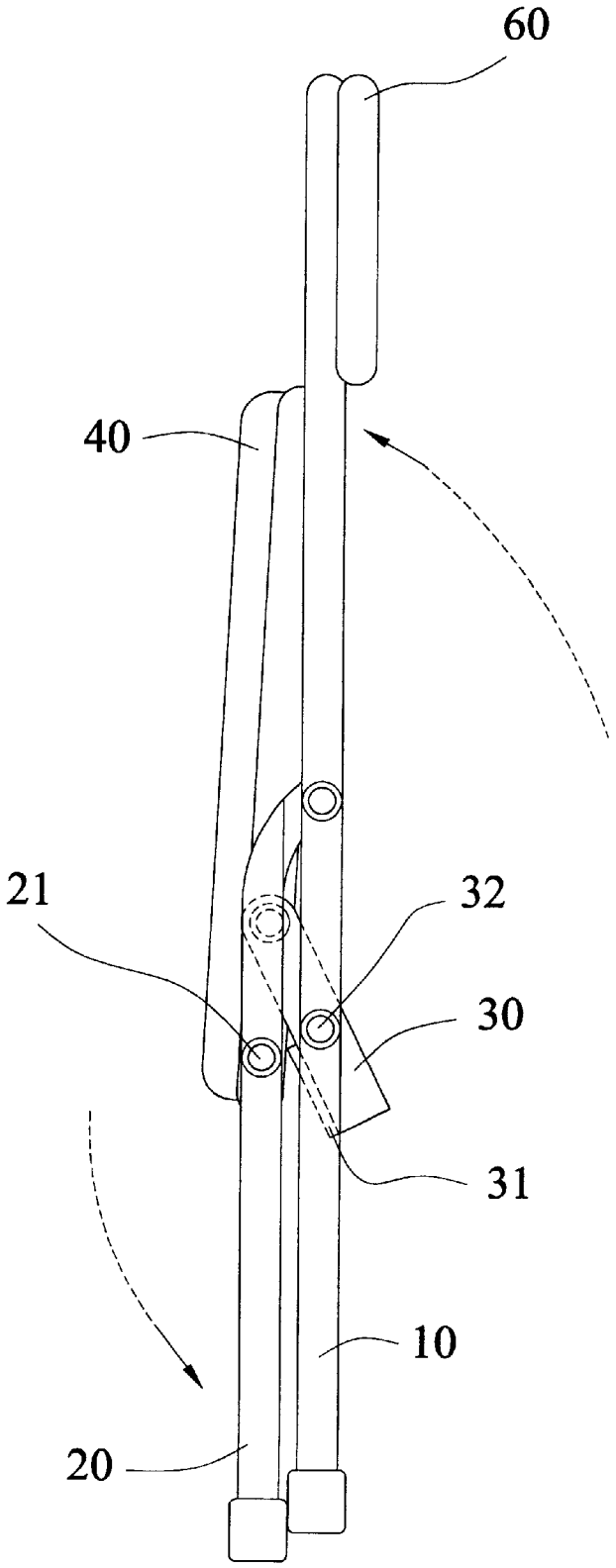
FIG. 6-B

FOLDABLE CHAIR SUPPORTED BY REAR SUPPORTING LEGS

FIELD OF THE INVENTION

The present invention relates to a foldable chair supported by rear supporting legs. Even the user leans against the chair back, the chair of the present invention is still steady. The force is suffered uniformly by four legs. After being folding, the volume occupied does not increase. Therefore, the packaging material will be saved.

BACKGROUND OF THE INVENTION

Chairs are widely used in daily life. While foldable chairs have the advantage of being folded so as to occupy a small volume, thus, foldable chairs are used more and more widely. FIG. 1 shows a general used foldable chair. The front supporting leg 10 is pivotally connected to the seat 40 by a pin 11. The rear supporting leg 20 is pivotally connected to the positioning confining piece 50 which is pivotally to the seat 40. The lower end of the positioning confining piece 50 has a concave groove 51. The seat 40 is installed with a positioning confining pin 41 which may be buckled into the groove 51 of the positioning confining piece 50. When the foldable chair is expanded, the seat 40 is pressed downwards, so that the pin 11 rotates around the fulcrum. When the groove 51 of the positioning confining piece 50 is buckled into the positioning confining pin 41, the foldable chair is expanded. Since in the prior art, the force is mostly suffered by the front supporting legs 10, the upward force can not be applied between the rear end of the seat 40 and the pin 11. Therefore, if a slightly force is applied to the rear end of the seat 40, the seat 40 will rotate backwards so that the chair is folded. The chair back 61 has often a flat plate. Thus the rear place of the seat 40 can not be used as a user sits on the seat 40, and he (or she) can not lean on the chair back. Moreover, since the pin 11 serves as a fulcrum. The rear supporting legs 20 has no structure for bearing the pressure of seat 40. Thus, the whole force is suffered by pin 11, and therefore, the pin 11 is easily destroyed.

FIG. 2 shows another prior art foldable chair. The rear supporting legs 20 are against the higher position of the front supporting legs 10 so to bear the downward force of the chair back. A further connected piece 22 serves to connect the rear supporting leg with the front supporting leg for avoiding the deformation induced by the distal end of the seat 40. Therefore, the user may lean against the chair back 62 so that the seat 40 will not be turned down or folded. The chair back 64 may have a cambered shape. However, in order to be installed with the connected piece 22, the joint of the front supporting leg and the rear supporting leg is higher. Moreover, since the force equilibrium position of the connecting piece 22 and the rear supporting leg 20 is higher. In order that the chair may be folded successfully, thus the height of the chair back 62 is higher. Although when the chair is expanded, the seat 40 would not be affected, however, after folded, the whole height is higher, thus the packaging volume is increased (referring to FIGS. 5A and 5B). This has a bad effect for carrying or storing.

SUMMARY OF THE INVENTION

Accordingly, the primary object of the present invention is to provide a foldable chair supporting by rear supporting legs so that the force due to a user leaning against the chair back may be suffered, moreover the chair back has a cambered shape.

Another object of the present invention is to provide a foldable chair supporting by rear supporting legs. The forces of all fulcrums are uniformly distributed in the four legs and the force bearing area is enlarged in order to increase the stability and tolerance of the present invention.

A further object of the present invention is to provide a foldable chair supporting by rear supporting legs which has a reduced folded area for saving packaging material.

In order to attain the aforementioned objects, the present invention provides a foldable chair supported by rear supporting legs. The foldable chair supporting by rear supporting legs including a seat, a pair of rear supporting leg, a pair of front supporting leg, and a pair of positioning pieces, one end of the positioning piece is pivotally to the front supporting leg. Another end is pivotally installed to a stopper which may lean against the seat. The rear supporting leg is directly and pivotally installed to the seat.

The front supporting leg suffers the downward force of the seat by the stopper, but the rear supporting legs suffer the downward force. The tolerance of the present invention is increased and the backward force from the human body is suffered by the four legs. After being folding, the volume occupied does not increase. Therefore, the packaging material will be saved.

The various objects and advantages of the present invention will be more readily understood from the following detailed description when read in conjunction with the appended drawing.

BRIEF DESCRIPTION OF THE DRAWINGS

FIG. 5A is a schematic view showing the state that the seat of FIG. 2 is expanded.

FIG. 5B is a schematic view showing a folding seat of FIG. 2 being folded.

FIG. 6A is a schematic view showing that the seat of the present invention is expanded.

FIG. 6B is a schematic view showing that the present invention is folded.

DETAILED DESCRIPTION OF THE PREFERRED EMBODIMENTS

Figure 1:
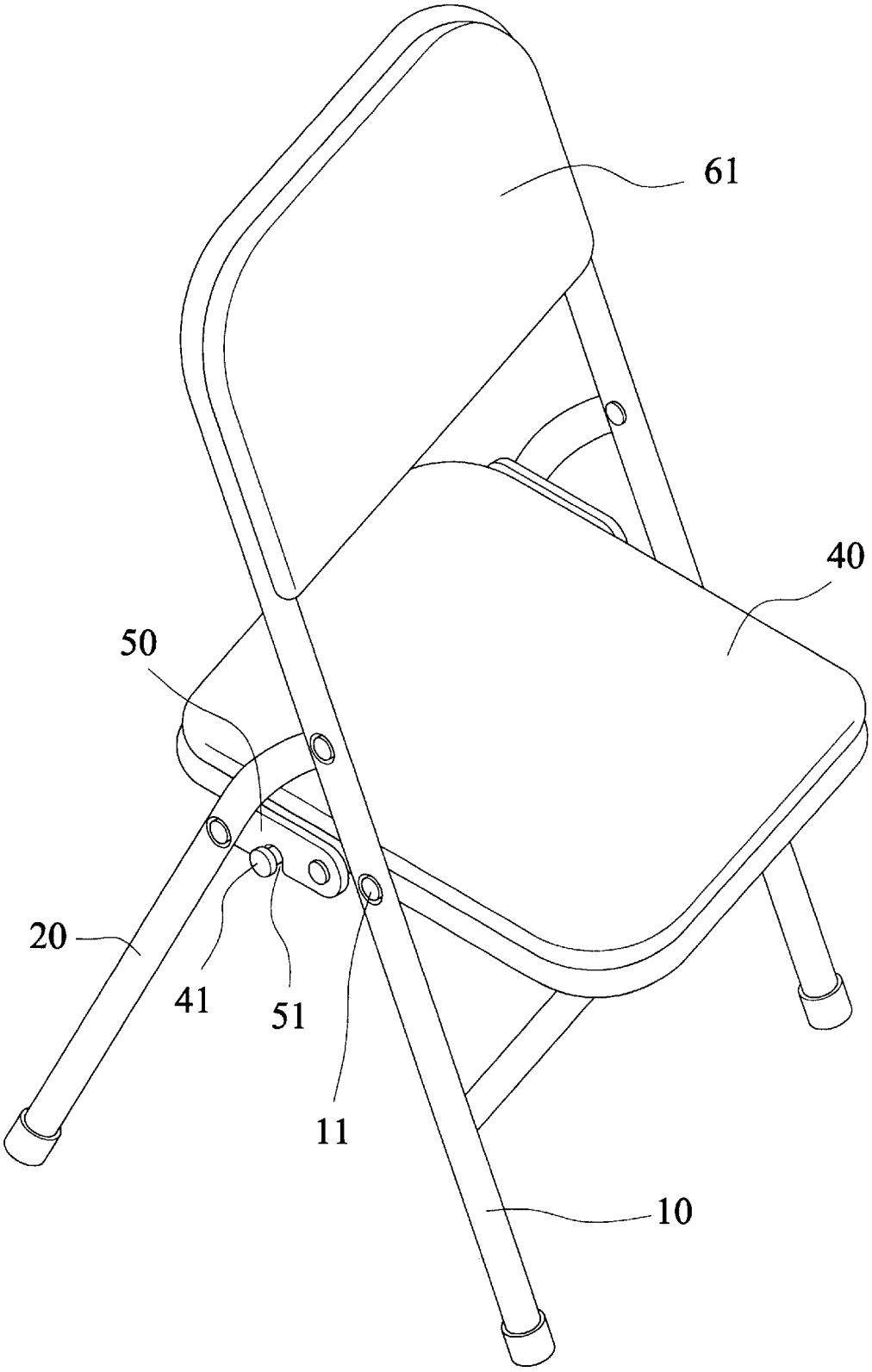
FIG. 1 show the structure of a prior art.
Figure 2:
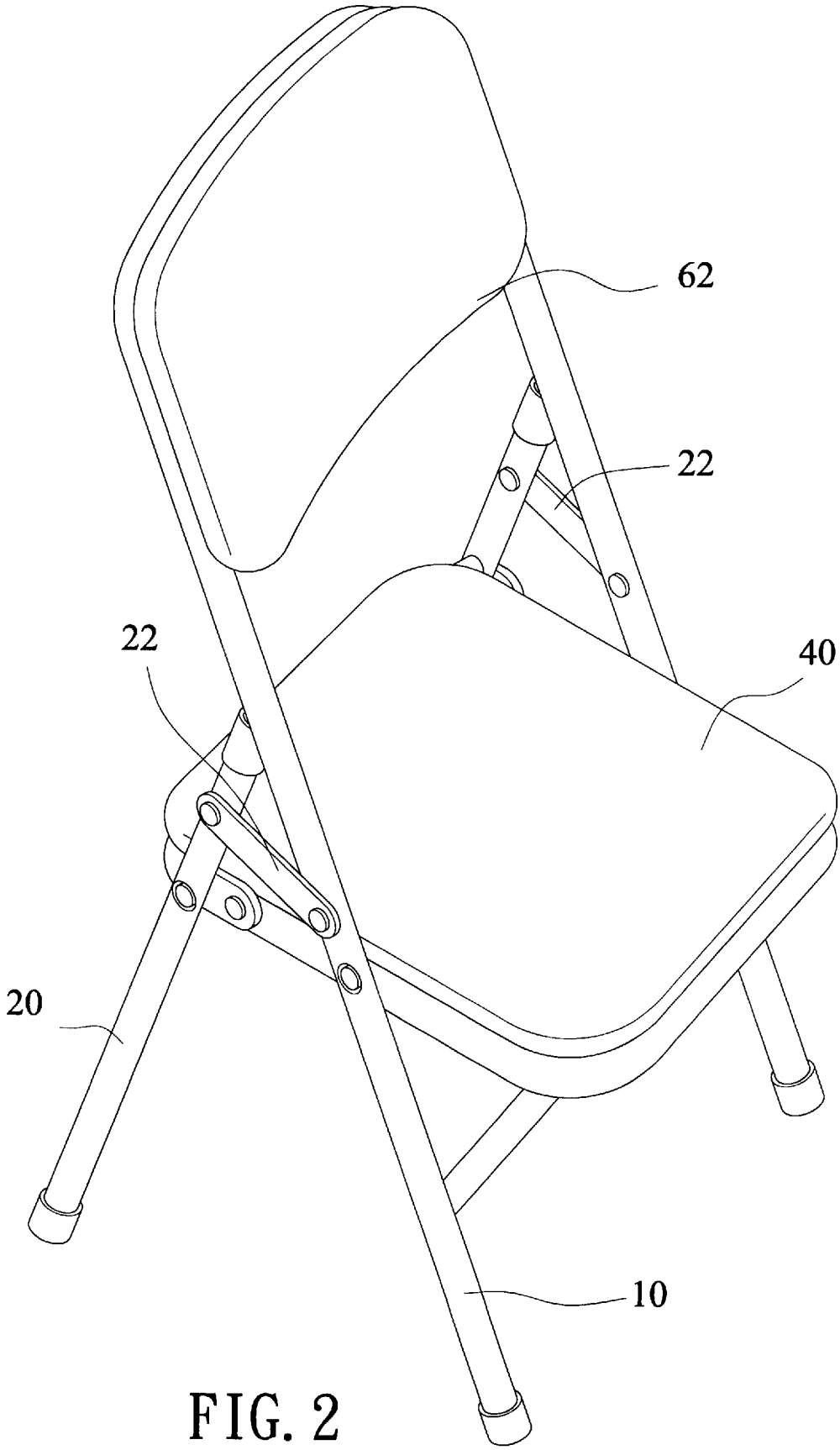
FIG. 2 shows a prior art structure.
Figure 3:
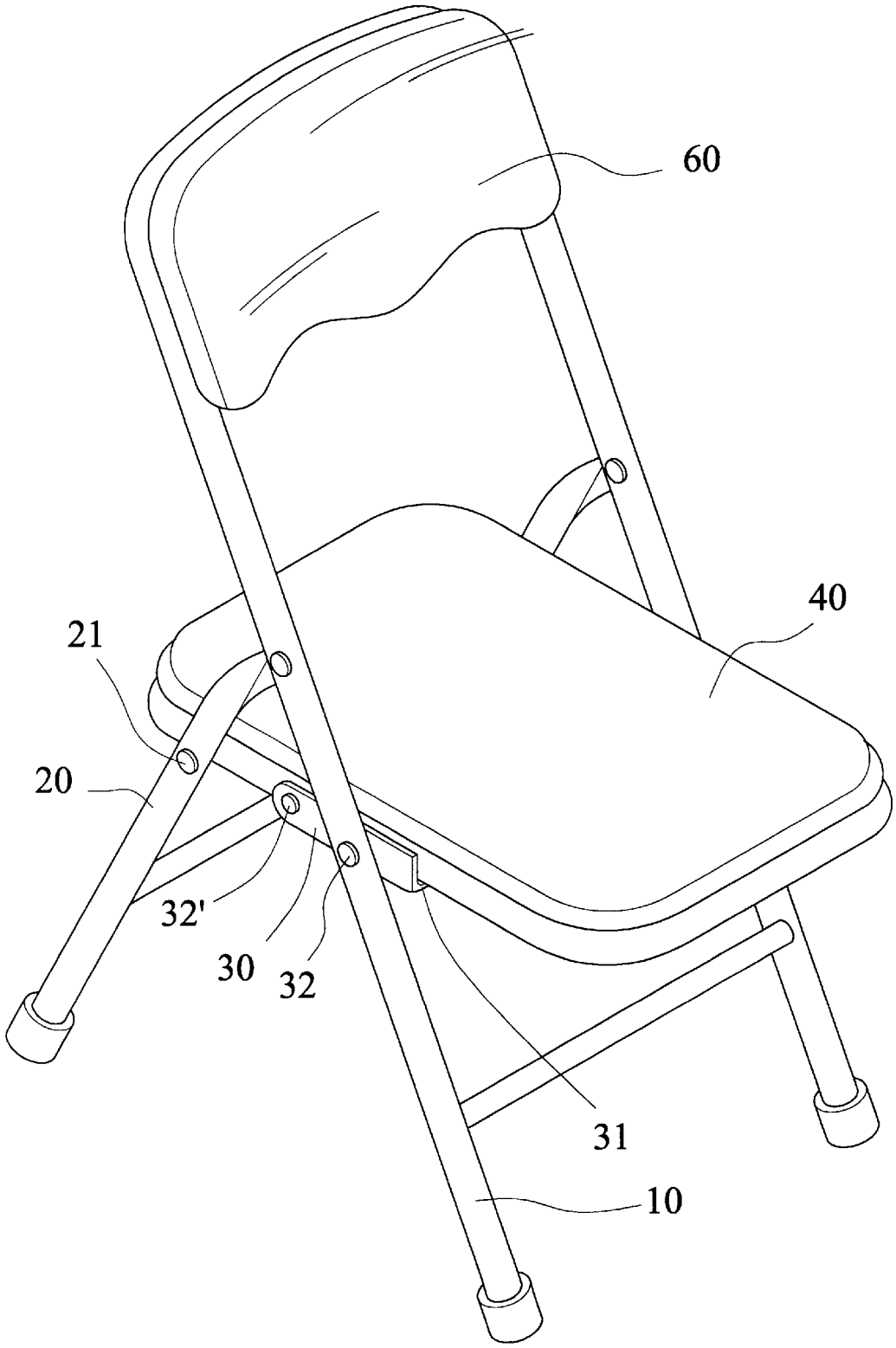
FIG. 3 is a perspective view of the embodiment in the present invention.
Figure 4:
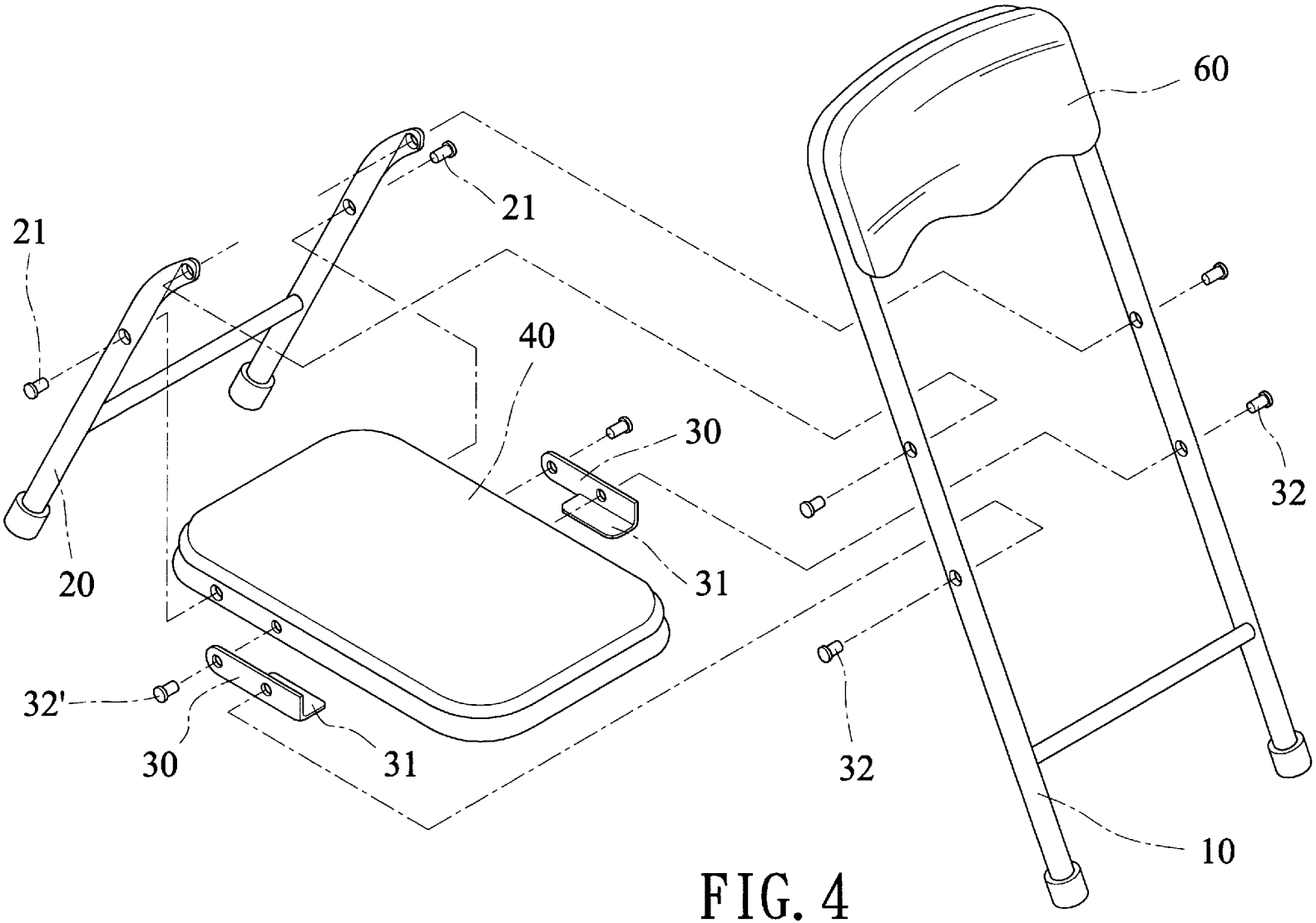
FIG. 4 is the exploded view of the components of the embodiment according to the present invention.

Referring to FIGS. 3 and 4, the foldable chair supported by rear supporting legs includes a pair of front supporting legs 10, a pair of rear supporting legs 20, a seat 40, a chair back 60 and a pair of positioning plates 30. One end of each positioning plate 30 is pivotally installed in the front supporting legs 10 by a pin 32. A stopper 31 is installed at another end in front of the connecting point of each rear supporting leg 20. The stopper 31 supports to below the seat 40 on an underside thereof. The rear supporting legs 20 are directly installed to the two sides of the distal end of the seat 40. The front supporting leg 10 is connected to the end portion of the rear supporting leg 20. The chair back 60 has a cambered shape and installed at the distal end of the front supporting legs 10.

When the seat 40 is expanded completely to its open or seating position, referring to FIG. 6A, in fact, the front supporting leg 10 and the positioning plate 30 are connected together by pin 32. The positioning plate 30 which is pivotally connected to the seat 40 by pin 32' and stopper 31 supports the lower side of the seat 40. While the rear supporting leg 20 is directly connected to the seat 40. Of course, the rear supporting leg 20 receives the downward force of the seat 40. While the stopper 31 and positioning plate 30 still suffer part of force. Therefore, the downward force suffered by the seat 40 are suffered by two pins 21 and 32. Namely, many force bearing points exist, and the bearing force of each point is decreased. Thus the stress of the each point is reduced effectively and thus the lifetime of the foldable chair is prolonged. Besides, the pins 21 and 32 form a plane which is more steadily than the prior art linear force bearing points. Therefore, the foldable chair can be steadily located.

Further, the pins 21 of the rear supporting legs 20 serves as fulcrums. Since the pins 21 is very near the seat 40, therefore, if a force is applied to the distal end of the seat 40 so that the seat 40 will be pulled upwards and folded. Thus, a large applied force is necessary for forming a desired torque. As a result, even the user sits in the distal end of the seat 40, he (or she) is unnecessary to worry about the seat 40 will be folded backwards. The chair back 60 is suitable to be a cambered surface for being leaned against by human body.

Besides, the rear supporting leg 20 is directly connected to the front supporting leg 10. The height of the connection points of both two legs is unnecessary to be increased. The position of the chair back 60 is also unnecessary to be increased. Thus, the whole elevation will not be increased. Comparing FIGS. 5B and 6B, after folding the present invention, the present invention has a smaller packaging volume. Thus, it can be transferred easily.

In summary, in the foldable chair supporting by rear supporting leg according to the present invention, the applied forces is suffered directly by rear supporting leg. Further, positioning plates are installed so that the supporting legs may suffer the applied force.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A foldable chair supported by rear supporting legs comprising a pair of front supporting legs, a pair of rear supporting legs, a seat, having a top and bottom portion, a chair back and a pair of longitudinally extending positioning plates, each of said positioning plates having opposite ends and an intermediate portion, wherein one end of each of said positioning plates is pivotally connected to said seat and an intermediate portion to said front supporting leg, each of said positioning plates including a stopper extending at right angles from said positioning plate and directed inwardly toward one another and adapted to engage a lower portion of said seat to thereby support an individual, the chair back is installed at the distal end of the front supporting legs, the front supporting legs suffer the downward force of the seat through the stopper, the rear supporting legs directly suffer the applied force, thus the downward force are suffered uniformly by the four supporting legs, and the force due to a user leaning against the chair back is suffered by the four legs.

2. The foldable chair supported by rear supporting legs as claimed in claim 1, wherein the chair back has a cambered surface.

3. The foldable chair supported by rear supporting legs as claimed in claim 1, wherein the front supporting leg is connected to the end portion of the rear supporting leg.

* * * * *